US007246917B2

(12) United States Patent
Rhoads et al.

(10) Patent No.: US 7,246,917 B2
(45) Date of Patent: Jul. 24, 2007

(54) APPARATUS AND METHOD FOR USING EMITTING DIODES (LED) IN A SIDE-EMITTING DEVICE

(75) Inventors: Greg Rhoads, Irvine, CA (US); Ronald Garrison Holder, Laguna Niguel, CA (US)

(73) Assignee: Illumination Management Solutions, Inc., Irvine, CA (US)

( * ) Notice: Subject to any disclaimer, the term of this patent is extended or adjusted under 35 U.S.C. 154(b) by 247 days.

(21) Appl. No.: 10/917,558

(22) Filed: Aug. 11, 2004

(65) Prior Publication Data

US 2005/0083699 A1 Apr. 21, 2005

Related U.S. Application Data

(60) Provisional application No. 60/494,469, filed on Aug. 12, 2003.

(51) Int. Cl.
*F21V 7/00* (2006.01)

(52) U.S. Cl. ..... 362/241; 362/247; 362/296; 362/327

(58) Field of Classification Search ..... 362/328, 362/241, 296, 247, 294, 327, 311, 293
See application file for complete search history.

(56) References Cited

U.S. PATENT DOCUMENTS

| | | | | |
|---|---|---|---|---|
| 826,205 | A | 7/1906 | Whitehouse | |
| 2,666,193 | A | 1/1954 | Keegan | |
| 4,101,957 | A | 7/1978 | Chang | |
| 4,151,584 | A | 4/1979 | Labrum | |
| 4,211,955 | A | 7/1980 | Ray | |
| 4,286,311 | A | 8/1981 | Maglica | |
| 4,388,673 | A | 6/1983 | Maglica | |
| 4,392,187 | A | 7/1983 | Bornhorst | |
| 4,398,238 | A | 8/1983 | Nelson | |
| 4,500,947 | A | 2/1985 | Perkins | |
| 4,530,040 | A | 7/1985 | Petterson | |
| 4,533,984 | A | 8/1985 | Gatton | |
| 4,570,208 | A | 2/1986 | Sassmannshausen | |
| 4,577,263 | A | 3/1986 | Maglica | |
| 4,583,153 | A | 4/1986 | Tsuyama | |
| 4,651,257 | A * | 3/1987 | Gehly | 362/33 |
| 4,698,730 | A | 10/1987 | Sakai et al. | |
| 4,727,289 | A | 2/1988 | Uchida | |
| 4,729,076 | A | 3/1988 | Masami et al. | |
| 4,733,337 | A | 3/1988 | Bieberstein | |

(Continued)

*Primary Examiner*—Jong-Suk (James) Lee
*Assistant Examiner*—Jacob Y. Choi
(74) *Attorney, Agent, or Firm*—Myers Dawes Andras & Sherman LLP

(57) ABSTRACT

An LED having a predetermined direction of radiation is combined with a first and second reflector. The first reflector opposes the LED and has a predetermined direction of reflection. The direction of reflection of the first reflector opposes the direction of radiation of the LED. The second reflector has a predetermined azimuthal direction of reflection. The second reflector positioned relative to the first reflector to receive light from the first reflector and redirect the light into the azimuthal direction of reflection. The LED, first and second reflectors collectively comprise an illumination unit. A plurality of illumination units are axially stacked. In one embodiment of the stack, at least one illumination unit comprises an LED and second reflector of one illumination unit and a first reflector of an adjacent illumination unit in the stack of illumination units.

20 Claims, 5 Drawing Sheets

U.S. PATENT DOCUMENTS 4,745,531 A 5/1988 Leclercq
4,755,916 A * 7/1988 Collins ..... 362/236
4,803,605 A 2/1989 Schaller et al.
4,814,950 A 3/1989 Nakata
4,941,070 A 7/1990 Ogawa et al.
4,959,757 A 9/1990 Nakata
4,962,450 A 10/1990 Reshetin
5,060,120 A 10/1991 Kobayashi et al.
5,072,346 A 12/1991 Harding
5,072,347 A 12/1991 Brunson
5,103,381 A 4/1992 Uke
5,249,109 A 9/1993 Denison et al.
5,268,977 A 12/1993 Miller
5,282,121 A 1/1994 Bornhorst et al.
5,477,263 A 12/1995 O'Callaghan
5,526,248 A 6/1996 Endo
5,528,474 A 6/1996 Roney et al.
5,577,493 A 11/1996 Parkyn et al.
5,618,102 A 4/1997 Ferrell
5,630,661 A 5/1997 Fox
5,634,711 A 6/1997 Kennedy et al.
5,673,990 A 10/1997 Neumann et al.
5,711,590 A 1/1998 Gotoh et al.
5,808,775 A 9/1998 Inagaki et al.
5,857,767 A 1/1999 Hochstein
5,897,196 A 4/1999 Soskind et al.
5,899,559 A 5/1999 Lachmayer et al.
5,904,417 A 5/1999 Hewett
5,924,785 A 7/1999 Zhang et al.
5,934,795 A 8/1999 Rykowski et al.
5,954,428 A 9/1999 Eichhorn et al.
5,986,779 A 11/1999 Tanaka et al.
6,007,210 A 12/1999 Yamamoto et al.
6,045,240 A 4/2000 Hochstein
6,076,948 A 6/2000 Bukosky et al.
6,123,440 A 9/2000 Albou
6,168,288 B1 1/2001 St. Claire
6,220,736 B1 4/2001 Dobler et al.
6,227,685 B1 5/2001 McDermott
6,252,338 B1 6/2001 Bergman et al.
6,280,071 B1 8/2001 Yamamoto et al.
6,354,721 B1 3/2002 Zattoni
6,371,636 B1 4/2002 Wesson
6,406,171 B1 6/2002 Satsukawa et al.
6,485,160 B1 11/2002 Sommers et al.
6,502,952 B1 1/2003 Hartley
6,536,899 B1 3/2003 Fiala
6,547,423 B2 4/2003 Marshall et al.
6,575,609 B2 6/2003 Taniuchi et al.
6,575,610 B2 6/2003 Natsume
6,578,998 B2 * 6/2003 Zhang ..... 362/555
6,603,243 B2 8/2003 Parkyn et al.
6,641,287 B2 11/2003 Suchiro
6,679,618 B1 * 1/2004 Suckow et al. ..... 362/247
6,685,336 B1 2/2004 Neiser
6,695,462 B2 * 2/2004 Rohlfing et al. ..... 362/328
6,741,406 B2 5/2004 Kitamura et al.
6,796,690 B2 9/2004 Bohlander
6,796,698 B2 9/2004 Sommers et al.
6,827,467 B2 12/2004 Tenmyo
6,871,993 B2 * 3/2005 Hecht ..... 362/555
2002/0105809 A1 8/2002 Kuijk et al.
2002/0145884 A1 10/2002 Yamamoto
2003/0007359 A1 1/2003 Sugawara et al.
2003/0090906 A1 5/2003 Hayakawa
2004/0017685 A1 1/2004 Dedoro

* cited by examiner

APPARATUS AND METHOD FOR USING EMITTING DIODES (LED) IN A SIDE-EMITTING DEVICE

RELATED APPLICATIONS

The present application is related to U.S. Provisional Patent Application Ser. No. 60/494,469, filed on Aug. 12, 2003, which is incorporated herein by reference and to which priority is claimed pursuant to 35 USC 119.

BACKGROUND OF THE INVENTION

1. Field of the Invention

The invention relates to the field of light emitting diodes (LED) used in a side-emitting device.

2. Description of the Prior Art

The invention collects substantially all the light or energy radiating from an LED source and redirects it into a 360 degree circular beam of light. The propagating beam is similar in its conical planar radiation pattern to that of the beam of a conventional lighthouse Fresnel lamp system. There are, however, several substantial differences between the invention and such prior art systems. In the prior art only a portion of the energy from the lamp is collected. With a traditional navigational lamp system, a lamp is placed at the axis of a surface of rotation Fresnel lens. The lamp's axis is substantially collinear with the Fresnel lens. Light is collected from about plus and minus 45 degrees of the lamp's output into the beam. The light radiating from the lamp above and below 45 degrees does not become part of the beam, thus becoming a factor of the systems inefficiency.

In prior art side-emitting LED systems, the light radiating from the LED is modified with multiple surfaces creating a beam comprised of several distinct beam portions. The invention, however, provides a uniform beam with all rays traceable to a single point source. This allows the luminare designer to modify the radiated beam with simple optical elements that further control the entire beam.

BRIEF SUMMARY OF THE INVENTION

The invention provides very efficient collection efficiency of the energy radiating form an LED, and then distributes this energy into a planarized 360 degree light pattern with extraordinary control. The invention further includes thermal management and could include electronic control of the individual LEDs. The invention could be used in navigational lighting, decorative and architectural lighting, emergency lighting and other applications.

The invention is a highly efficient LED based device with an energy or power source, at least one LED coupled to the power source, at least one concave reflector surface directed toward the LED, and at least one substantially conical reflective surface positioned to collect and redirect light from the concave reflector in a side illumination pattern.

Additionally, the invention includes a heat sink for the LED that is provided as an additional element or may incorporated into the structure of the conical surface. The LED is mounted to a heat conductive material that provides the thermal management for the LED.

This structure of the illustrated embodiment also situates the LED over the concave reflector with the primary light direction of the LED facing the reflector. The reflector then reflects the light in the direction opposite the primary light direction of the LED. The light then reflects off the conical surface in a direction substantially perpendicular to an axis passing through the center of the LED and the center of revolution of the concave surface.

If a bridge structure is utilized as a heat sink for the LED, the mechanical design of the bridge is a predetermined compromise between occluding the light returning from the reflector and providing the proper thermal management for the LED.

The structure that aligns the components of the invention in place may include a transparent or semitransparent tube that provides axial alignment, mechanical positioning and/or protection. This tube may also include at least one surface that is either an optical lens or diffuser.

An apparatus incorporating the invention may be comprised of stacked units to provide additional functionality. The stacked systems may include two or more replications of the invention illustrated above that have been optimized by having a unique set of reflective components at one or both ends of the stacked units.

The beam width can be designed to be very narrow or up to Lambertian with either the primary surfaces, or the addition of modifying surfaces. A Lambertian source is an optical source that obeys Lambert's cosine law, i.e., that has an intensity directly proportional to the cosine of the angle from which it is viewed. Conventional (surface-emitting) LEDs are approximately Lambertian. They have a large beam divergence. This results in a radiation pattern that resembles a sphere.

The reflector may be designed to provide a collimated beam, a convergent beam or a divergent beam. The reflector may be a common conic section or not, and my be faceted, dimpled or otherwise modified to provide a desired beam pattern. The apparatus may also include at least one lens or surface that further controls the light radiating from the reflector. For example, the invention can be modified by use of a lens or lenses in front of the beam. These lenses could provide beam spread or convergence. A semitransparent colored material or filter could be placed in front of the beam to create a diffused light or an architectural light column. In some systems where optimal light output is desired at the expense of collimation, the central portion of the concave reflector may be modified to allow the light reflected from its surface to be directed into the opening between the outer edge of the concave reflector and the structure of the LED.

More particularly the apparatus of the invention comprises an LED light source having a predetermined direction of radiation. This does not mean, of course, that all of the rays of light are directed in the same direction, but only that there is a generally preferred direction of radiation, such as in a forward solid angle. A first reflector opposes the LED light source and has a predetermined direction of reflection. The direction of reflection of the first reflector opposes the direction of radiation of the LED light source. Again this does not mean that all of the reflected rays of light are directed in the same direction, but only that there is a generally preferred direction of reflection, such as in a forward solid angle. For example in the case of a parabolic reflector, light originating at a point source located at the focal point of the reflector would be collimated in a predetermined or in the forward direction on the optical axis of the reflector. A second reflector has a predetermined azimuthal direction of reflection. The second reflector positioned relative to the first reflector to receive light from the first reflector and redirect the light into the azimuthal direction of reflection. Once again this does not mean that all of the redirected rays of light are directed in the same direction, but only that there is a generally preferred direction of redirection, such as in a dihedral solid angle defined about a plane perpendicular to the optical axis of the second reflector or apparatus.

The first reflector comprises a generally concave reflector or in one embodiment a parabolic reflector. The second reflector comprises a generally conical reflector. The LED light source, first and second reflectors each have an optical axis and the optical axes of each are mutually aligned.

The apparatus further comprises a heat sink thermally coupled to the LED light source. The heat sink positions the LED light source within the apparatus. In one embodiment the heat sink comprises a hub coupled to the LED light source, at least one radially extending arm thermally coupled to the hub and a body thermally coupled to the arm. In another embodiment the second reflector is coupled to the LED light source, is comprised of a thermally conductive material, and acts as a heat sink for the LED light source.

In still a further embodiment the LED light source, first and second reflectors collectively comprise an illumination unit and further comprising a plurality of illumination units axially arranged and configured with respect to each other to provide a stack of illumination units. In one embodiment of the stack at least one illumination unit in the stack of illumination units comprises an LED light source and second reflector of one illumination unit and a first reflector of an adjacent illumination unit in the stack of illumination units. In another embodiment of the stack, the first and second reflectors comprise separate bodies. In yet another embodiment of the stack the first and second reflectors comprise a common body with two surfaces, one surface providing the first reflector and the other surface providing the second reflector. The stack of illumination units further comprises a first end element comprised of the first reflector and a second end element comprised of an LED light source and the second reflector.

The second reflector is arranged and configured to project central and field rays of light in an azimuthal pattern reflected from the first reflector. The central rays are approximately perpendicular to the optical axis of the second reflector, while the field rays diverge out of the plane perpendicular to the optical axis of the second reflector.

The LED light source, first and second reflectors are arranged and configured to provide a selected ratio of light intensity in the central rays to the field rays.

The LED light source, first and second reflectors are arranged and configured to provide the field rays with a selected degree of divergence.

The LED light source, first and second reflectors are arranged and configured to provide a beam of light in a 360 degree azimuthal pattern.

The apparatus further comprises a cylindrical transparent body azimuthally surrounding the second reflector through which the redirected light is transmitted. The cylindrical body comprises a color filter.

The LED light source comprises an LED light source having a selected color of radiated light, and in the stack embodiment each of the LED light sources in the stack comprises an LED light source having a selected color of radiated light with at least two of the selected colors being different from each other.

The invention is also defined as a method of generating a light beam using the above LED embodiments.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
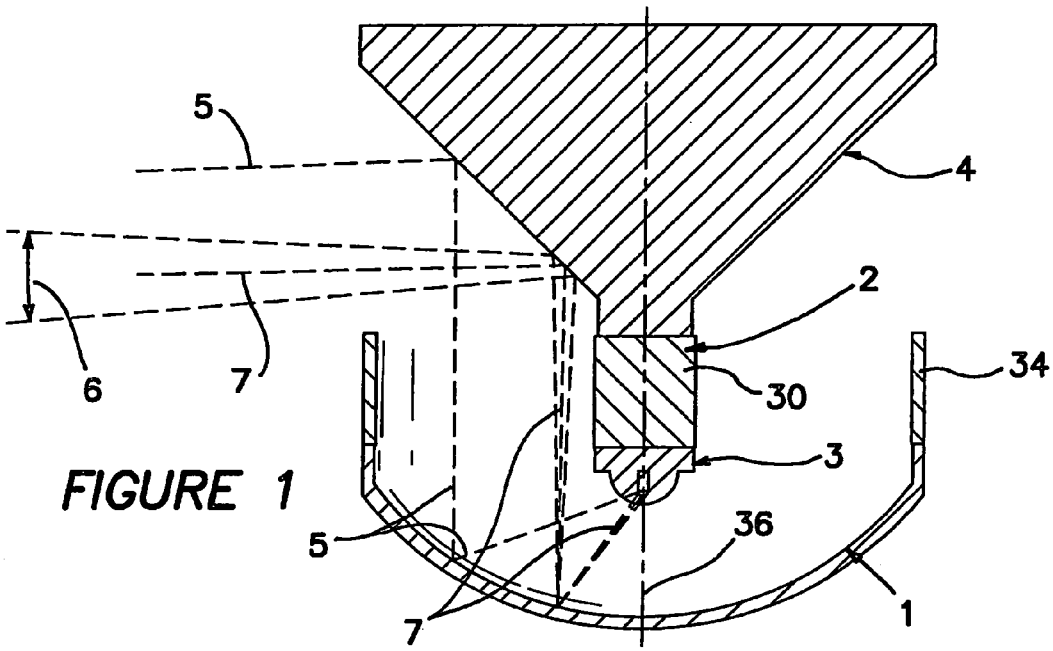
FIG. 1 is a side cross-sectional view of the optical elements of a first embodiment of the invention.
Figure 2:
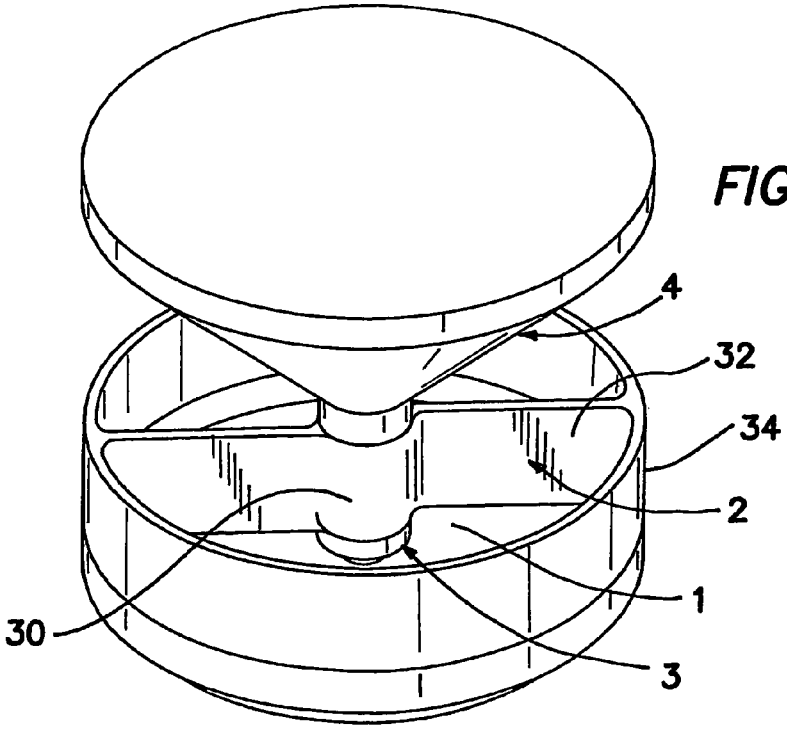
FIG. 2 is a perspective view of the optical elements of the embodiment of FIG. 1.

In FIGS. 1 and 2, an LED 3 is situated over or relative to a concave reflector 1 in such a manner to collect substantially all the energy radiated from LED 3 onto the concave reflective surface of reflector 1. LED 3 is a conventional LED integrated package, which includes a packaged chip in which the light emitting junction has been formed and typically providing with a hemispherical lens for directing the emitted light in a Lambertian pattern. However, it must be clearly understood that the invention can be used with any LED configuration or packaging now known or later devised. LED 3 is connected through wires or conductive leads (not shown) to a conventional drive circuit (not shown) powered in turn by a battery (not shown) or other conventional power source.

Heat sink 2 provides positional alignment and thermal management for the LED 3. LED 3 is coupled to heat sink 2, which in the illustrated embodiment is best shown in FIG. 2 as including a cylindrical hub 30 to which LED is mounted and thermally coupled. Hub 30 is connected to arms 32 which extend from hub 30 to a surrounding cylindrical body 34. Hence, heat sink 2 serves to align LED 3 on the optical axis 36 of the optical elements shown in FIG. 1 and to position it longitudinally as the desired point on the optical axis 36 relative to reflector 1. Heat sink 2, collectively comprised of hub 30, arms 32 and body 34 is composed of a thermally conductive material, typically a metal. The optical elements of FIGS. 1 and 2 must be understood as housed within an apparatus body, such as a conventional lamp housing or standard (not shown), which includes the possibility of further thermal coupling of material bodies to heat sink 2 to further dissipate heat from heat sink 2 and ultimately LED 3. Only the primary operative optical and thermal elements of the invention of the embodiment of FIGS. 1 and 2 have been illustrated in order to simplify the presentation of the invention.

FIG. 1 shows light rays 5, 6 and 7 from LED 3 being reflected toward a substantially conical or inclined reflective surface 4. Rays 5 and 7 represent the class of rays which are emitted from LED 3 and are reflected first by reflector 1 and then by surface 4 in a direction which is substantially perpendicular to the optical axis 36. Such rays 5 and 7 are defined as "central rays". Ray 6 represents the class of rays which are emitted from LED 3 and are reflected first by reflector 1 and then by surface 4 in a direction which is divergent from the plane perpendicular to optical axis 36. Ray 6 is defined as the "field ray". Each central ray 5, 7 has associated field rays 6 that describe the projected light angle of the apparatus.

When reflected off conical surface 4 the light is distributed azimuthally into a 360 degree beam about the perpendicular plane. This beam, collectively comprised of central and field rays, can be controlled by design of reflector 1 and reflective surface 4 and/or the design of additional optics that can be incorporated to shape the beam as substantially radiating from a theoretical point source. For example, the ratio of light intensity of the central rays to the field rays can be selected as well as the magnitude of the projected light angle of the field rays.

Figure 3:
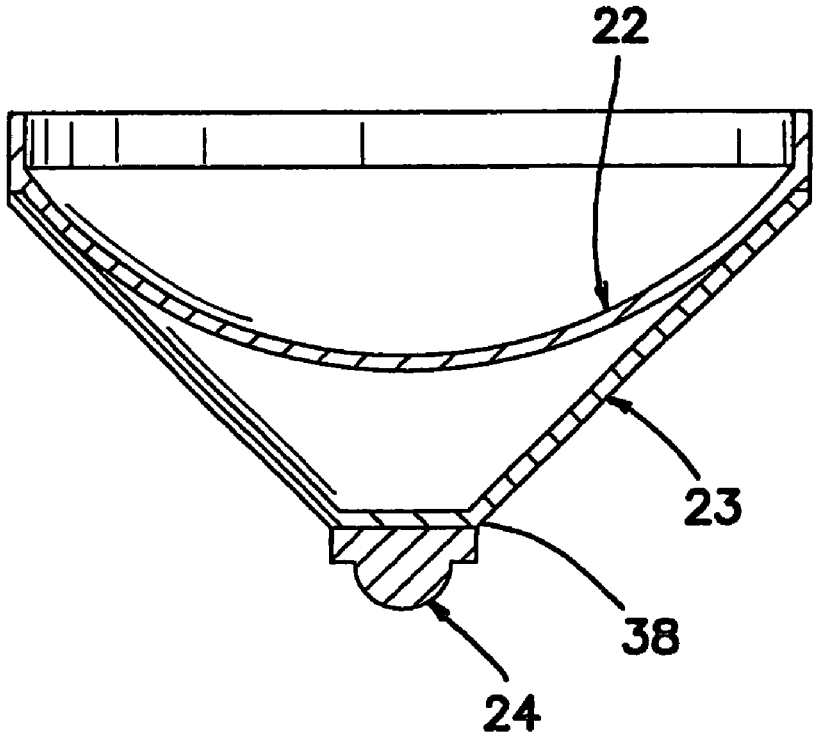
FIG. 3 is a side cross-sectional view of the optical elements of a second embodiment of the invention.
Figure 6:
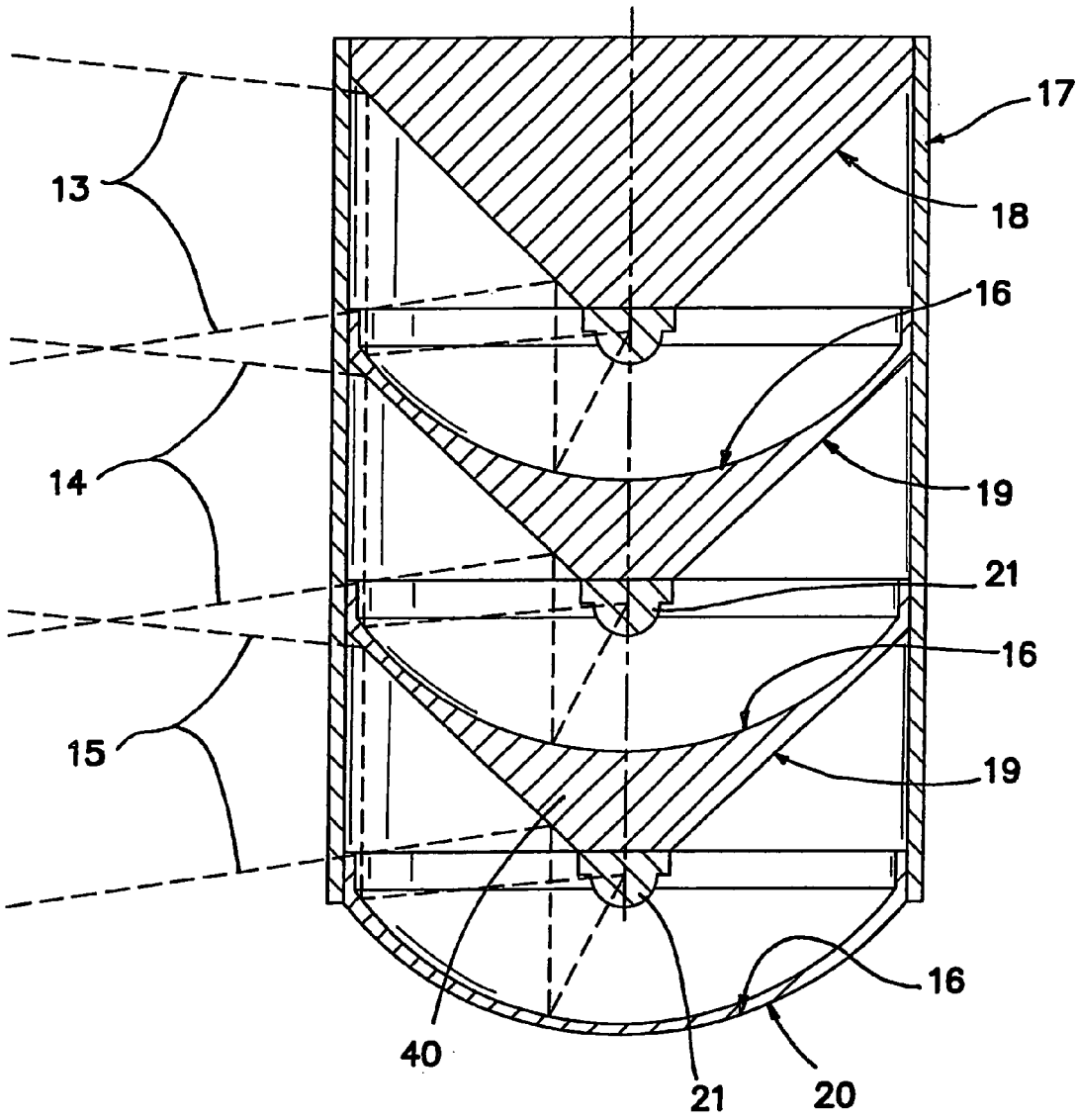
FIG. 6 is a side cross-sectional view of a fourth embodiment of the invention where multiple units have been combined in a stacked array.
Figure 7:
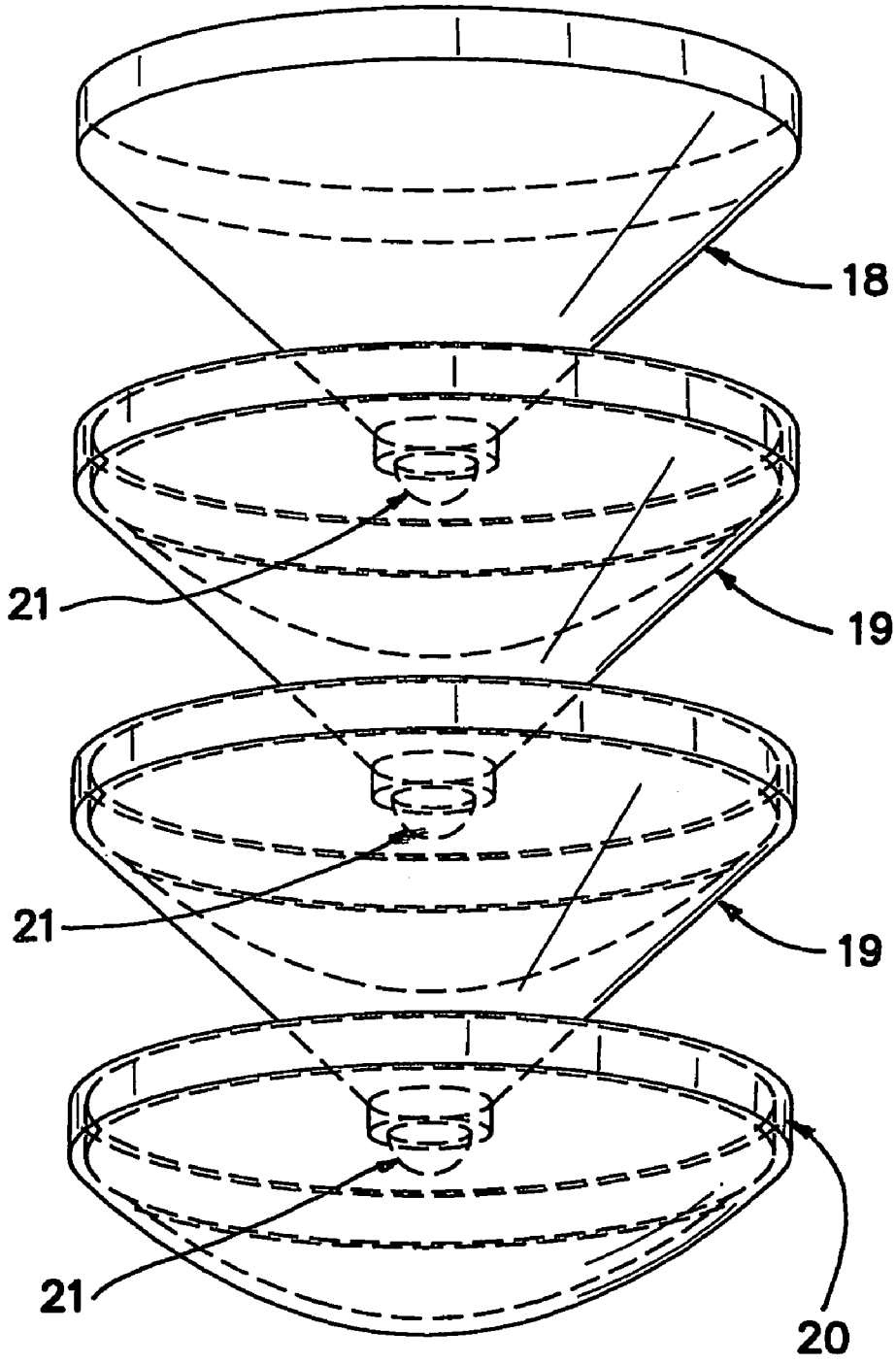
FIG. 7 is a perspective view of some of the optical elements of the embodiment of FIG. 6.

FIG. 3 illustrates one embodiment of the invention made as a separate piece to facilitate manufacture, which embodiment can be used in a stackable version of the invention similar to that shown in FIGS. 6 and 7. The LED 24 in the embodiment of FIG. 3 is coupled to the base 38 of conical reflector 23 which is nested or stacked with concave reflector 22 of the LED unit which will be formed or stacked above it. Thus, when the unit of FIG. 3 is replicated and stacked or concatenated with an identical unit, the concave reflector 22 of the unit below operatively combines with the conical reflective surface 23 of the unit above to provide the same combination of FIGS. 1 and 2.

Figure 4:
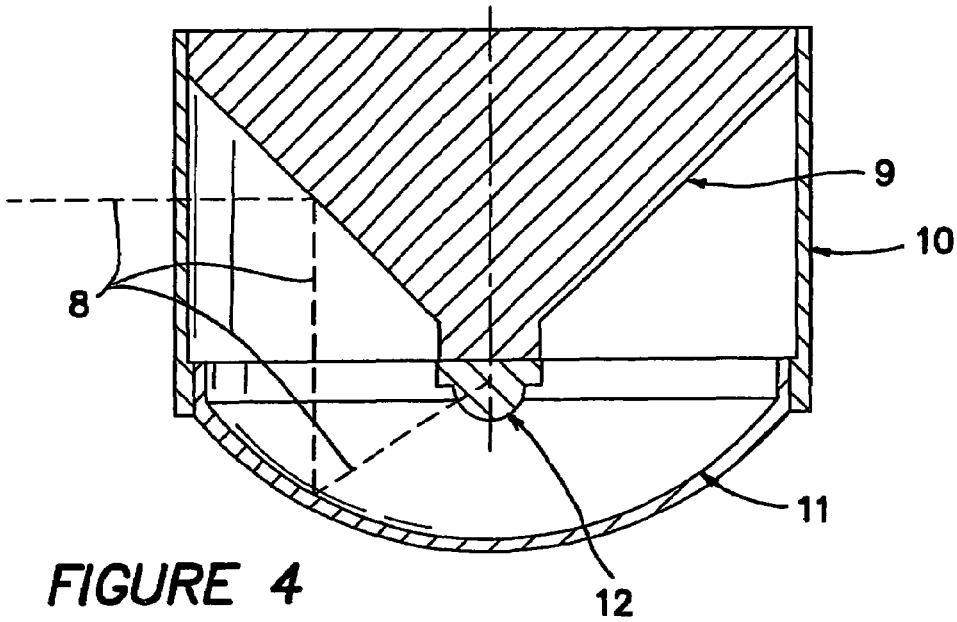
FIG. 4 is a side cross-sectional view of the optical elements of a third embodiment of the invention.
Figure 5:
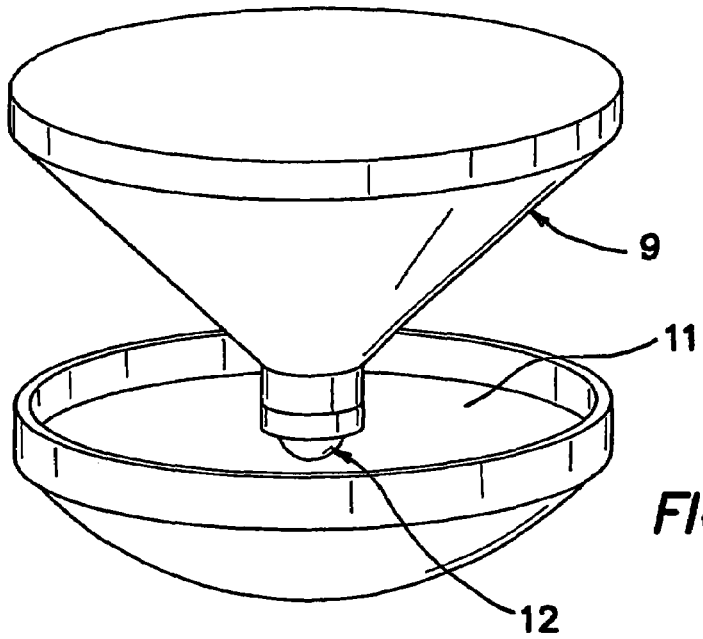
FIG. 5 is a perspective view of some of the optical elements of the embodiment of FIG. 4.

FIGS. 4 and 5 illustrate another embodiment whereby a stackable collection of units like that shown in FIGS. 6 and 7 can be manufactured in units similar to that shown in FIGS. 1 and 2. Ray 8 is shown radiating from LED 12 to concave reflector 11 to conical reflector 9 and finally into the azimuthal beam. The LED 12 and conical reflector 9 are aligned in a transparent tube 10 as best seen in FIG. 4, which tube 10 is omitted from FIG. 5 for the sake of simplicity of illustration. Supporting conical reflector 9 is comprised of thermally conductive material and provides for the thermal management of LED 12, thus eliminating the attenuating arms of the heat sink 2 of FIGS. 1 and 2.

FIGS. 6 and 7 illustrate a preferred embodiment of the invention comprised of a series of at least two or more units situated or stacked in substantially an axial manner. The field beams 13, 14 and 15 radiating from the individual units combine to form a single beam at a predetermined distance from the common optical axis of the stacked units. The units are stacked in the embodiment of FIGS. 6 and 7 within a single transparent tube 17 best shown in FIG. 6 and omitted from FIG. 7 for the sake of clarity. The center units 19 may be constructed in the manner as shown in FIG. 6 where the concave surface 16 is formed in the upper surface of a common body 40, the lower portion of which provides the conical reflective surface 19 or may be made in two pieces similar to the unit of FIG. 3. The end concave reflector element 20 shown at the bottom of the stack in FIG. 6 and the upper end conical reflector 18 may be constructed differently than the center units 19 as a manufacturing optimization if desired. The LEDs 21 may similar in color or different colors from each other.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus comprising:

a single LED point light source having a predetermined direction of radiation into a forward hemisphere;

a first reflector opposing the LED light source and having a single optical axis in a predetermined direction of reflection, the direction of reflection of the first reflector opposing the direction of radiation of the LED light source, the first reflector receiving substantially all of the light radiated by the LED light source; and a separate second reflector having predetermined azimuthal directions of reflection, the second reflector spaced apart from the first reflector and positioned relative to the first reflector to receive substantially all of the light reflected from the first reflector which is not incident on the LED light source and to redirect substantially all of the once reflected light into the azimuthal directions of reflection with no more than a second reflection.

2. The apparatus of claim 1 where the first reflector comprises a generally concave reflector.

3. The apparatus of claim 2 where the concave reflector comprises a parabolic reflector.

4. The apparatus of claim 2 where the second reflector comprises a generally conical reflector.

5. The apparatus of claim 1 where the second reflector comprises a generally conical reflector.

6. The apparatus of claim 1 where the LED light source, first and second reflectors each have an optical axis and where the optical axis of each are mutually aligned.

7. The apparatus of claim 1 further comprising a heat sink thermally coupled to the LED light source.

8. The apparatus of claim 7 where the heat sink positions the LED light source within the apparatus.

9. The apparatus of claim 7 where the heat sink comprises a hub coupled to the LED light source, at least one radially extending arm thermally coupled to the hub and a body thermally coupled to the arm.

10. The apparatus of claim 1 where the second reflector is coupled to the LED light source, is comprised of a thermally conductive material, and acts as a heat sink for the LED light source.

11. The apparatus of claim 1 where the LED light source, first and second reflectors collectively comprise an illumination unit and further comprising a plurality of illumination units axially arranged and configured with respect to each other to provide a stack of illumination units.

12. The apparatus of claim 11 where at least one illumination unit in the stack of illumination units comprises an LED light source and a single body on which is provided the second reflector of the one illumination unit and a first reflector of an adjacent illumination unit in the stack of illumination units.

13. The apparatus of claim 12 where the stack of illumination units further comprises a first end element comprised of the first reflector and a second end element comprised of an LED light source and the second reflector.

14. The apparatus of claim 11 where each of the LED light sources in the stack comprises an LED light source having a selected color of radiated light with at least two of the selected colors being different from each other.

15. The apparatus of claim 1 where the second reflector is arranged and configured to project central rays of light in an azimuthal pattern reflected from the first reflector and to project field rays of light in an azimuthal pattern reflected from the first reflector.

16. The apparatus of claim 15 where the LED light source, first and second reflectors are arranged and configured to provide a selected ratio of light intensity in the central rays to the field rays.

17. The apparatus of claim 15 where the LED light source, first and second reflectors are arranged and configured to provide the field rays with a selected degree of divergence.

18. The apparatus of claim 1 where the LED light source comprises an LED light source having a selected color of radiated light.

19. An apparatus comprising:

an LED light source having a predetermined direction of radiation;

a first reflector opposing the LED light source having a predetermined direction of reflection, the direction of reflection of the first reflector opposing the direction of radiation of the LED light source; and a second reflector having a predetermined azimuthal direction of reflection, the second reflector positioned relative to the first reflector to receive light from the first reflector and to redirect the light into the azimuthal direction of reflection.

where the LED source, first and second reflectors collectively comprise an illumination unit and further comprising a plurality of illumination units axially arranged and configured with respect to each other to provide a stack of illumination units, where the first and second reflectors comprise a common body with two surfaces, one surface providing the first reflector and the other surface providing the second reflector.

20. A method comprising:

generating light from an LED light source in a predetermined direction of radiation;

reflecting light from a first reflector opposing the LED light source in a predetermined direction of reflection, the direction of reflection opposing the direction of radiation of the LED light source;

reflecting light from a second reflector having a predetermined azimuthal direction of reflection, the second reflector positioned relative to the first reflector to receive light from the first reflector and to redirect the light into the azimuthal direction of reflection; and combining the LED light source, first and second reflectors collectively as an illumination unit and axially stacking a plurality of illumination units, where axially stacking a plurality of illumination units comprises employing an LED light source and second reflector of one illumination unit and a first reflector of an adjacent illumination unit as a replicated combination in the stack, where employing an LED light source and second reflector of one illumination unit and a first reflector of an adjacent illumination unit comprises providing the first and second reflectors on a common body with two surfaces, one surface providing the first reflector and the other surface providing the second reflector.

* * * * *